US007294442B2

(12) United States Patent
Takada et al.

(10) Patent No.: US 7,294,442 B2
(45) **Date of Patent: *Nov. 13, 2007**

(54) TONER FOR DEVELOPING ELECTROSTATIC IMAGE, METHOD FOR MANUFACTURING THE TONER, DEVELOPER INCLUDING THE TONER, CONTAINER CONTAINING THE TONER, AND COLOR IMAGE FORMING METHOD USING THE TONER

(75) Inventors: Takeshi Takada, Numazu (JP); Chiaki Tanaka, Tagata-gun (JP); Naohiro Watanabe, Suntou-gun (JP)

(73) Assignee: Ricoh Company. Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/588,336

(22) Filed: Oct. 27, 2006

(65) Prior Publication Data

US 2007/0042284 A1 Feb. 22, 2007

Related U.S. Application Data

(63) Continuation of application No. 10/804,084, filed on Mar. 19, 2004.

(30) Foreign Application Priority Data

Mar. 19, 2003 (JP) ..... 2003-075136

(51) Int. Cl.
*G03G 9/08* (2006.01)

(52) U.S. Cl. ..... 430/111.4; 430/109.1; 430/109.4; 430/137.15

(58) Field of Classification Search ..... 430/111.4, 430/109.1, 109.4, 137.15, 137.17
See application file for complete search history.

(56) References Cited

U.S. PATENT DOCUMENTS 2,297,691 A 10/1942 Carlson

FOREIGN PATENT DOCUMENTS

JP 2986820 10/1999
JP 2000-194160 7/2000

*Primary Examiner*—Mark A. Chapman
(74) *Attorney, Agent, or Firm*—Oblon, Spivak, McClelland, Maier & Neustadt, P.C.

(57) ABSTRACT

A toner for developing an electrostatic image having a good combination of hot offset resistance and low temperature fixability. The toner includes (1) a resin having at least one group that can react with a compound having an active hydrogen in an amount of 2 pieces per molecule of the resin, and a colorant. The toner satisfies the following relationship: $3 \leqq G = R - R_{ideal} \leqq 20$, where G represents a ratio of a weight of components other than the colorant and the resin that are insoluble in the organic solvent to total weight of the toner, R represents a weight ratio of components included in the toner that are insoluble in the organic solvent to the total weight of the toner, and $R_{ideal}$ represents an ideal weight ratio of the colorant and the resin, which is calculated from a formula of the toner.

3 Claims, 2 Drawing Sheets

TONER FOR DEVELOPING ELECTROSTATIC IMAGE, METHOD FOR MANUFACTURING THE TONER, DEVELOPER INCLUDING THE TONER, CONTAINER CONTAINING THE TONER, AND COLOR IMAGE FORMING METHOD USING THE TONER

CROSS-REFERENCE TO RELATED APPLICATIONS

This application is related to and claims priority to Japanese Patent Application No. 2003-075136, filed on Mar. 19, 2003, the contents of which are incorporated herein by reference.

BACKGROUND OF THE INVENTION

1. Field of the Invention

The present invention relates to a toner for visualizing a latent electrostatic image formed on an image bearing member by methods including electrophotography and electrostatic recording methods. In addition, the present invention also relates to a developer including the toner, an image forming method using the toner and a toner container containing the toner.

2. Discussion of the Background

U.S. Pat. No. 2,297,691 and published examined Japanese Patent Applications Nos. 49-23910 and 43-24748 disclose various kinds of methods for image developing by electrophotography. In general, electrostatic latent images, which are formed on an image bearing member using a method such as electrophotography, electrostatic recording, and electrostatic printing, are developed with a developer in order to be visualized.

For example, visual images are typically formed as follows:

(1) a latent electrostatic image is formed on an image bearing member such as photoreceptors which is made of photosensitive materials (latent image forming process);
(2) the latent electrostatic image is developed with a developer including a toner to form a toner image on the image bearing member (developing process);
(3) the toner image is transferred onto a receiving material, such as paper, optionally via an intermediate transfer medium (transfer process); and
(4) the toner image on the receiving material is fixed upon application of heat, pressure, solvent vapor, etc. to form a hard copy (fixing process).

As methods for developing latent electrostatic images, there is a wet developing method, which uses a liquid developer prepared by finely dispersing various kinds of dyes and pigments in an insulative organic solution. Another typical method for developing latent electrostatic images is a dry developing method, such as a cascade method, a magnetic brush method, and a powder cloud method, which uses a dry developer (hereinafter referred to as toner) made by dispersing colorants such as carbon black in a natural or synthetic polymer. Recently the dry developing methods have been widely accepted. The fixing processes used in the dry developing methods are typically a contact heating fixing process, such as a heat roll fixing process, or a belt fixing process, since these processes are energy efficient. However, for the heat roll fixing process, there is a problem in that toners tend to excessively fuse and attach to the heat roll when the temperature thereof is too high. To the contrary, when the temperature of the heat roll is too low, toners tend not to fuse well, resulting in insufficiency of fixing. Therefore, toners having properties of a high hot offset temperature (hot offset resistance) and a low temperature fixing are required in light of the lowered energy consumption and miniaturization of developing devices.

In order to satisfy the hot offset resistance, ultra high molecular weight resins, which are sufficiently tough and elastic, are required. In contrast, low energy and sufficient fusibility and viscosity are necessary to have the property of low temperature fixing. Therefore low molecular weight resins having a low glass-transition temperature are required. Various approaches have been devised to obtain materials and methods satisfying both properties. Japanese Patent No. 2986820 and published unexamined Japanese Patent Application No. 2000-194160 disclose methods of using a binder resin including both a low molecular weight component and high molecular weight component (e.g., a cross-linked and branched ultra-high molecular weight component). However, these methods have drawbacks in that (1) the added amount of the ultra-high molecular weight component is limited due to its poor solubility or mutual solubility of the high molecular weight component, and the low molecular weight component and (2) the ultra-high molecular weight component, which has a sufficient elasticity, worsens the property of low temperature fixing.

Therefore, the need still exists for a toner having both properties of hot offset resistance and low temperature fixing.

SUMMARY OF THE INVENTION

Accordingly, one object of the present invention is to provide a toner for developing an electrostatic image, the toner having both properties of hot offset resistance and low temperature fixing.

Another object of the present invention is to provide a method of manufacturing the toner having the properties mentioned above.

Briefly, it will become readily apparent that these objects and other objects of the present invention as hereinafter described can be attained by a toner for developing an electrostatic image which includes a binder resin and a colorant.

The toner is prepared by (1) dissolving or dispersing a first resin, which has at least one group reactive with a compound having active hydrogen, in an amount of at least an average of 2 pieces per molecule of the first resin and the colorant, in an organic solvent to prepare a toner constituent liquid, and (2) mixing the toner constituent liquid with an aqueous medium that contains fine particles of a second resin, and at least one of a crosslinking agent and an elongation agent to perform at least one of a crosslinking reaction and an elongation reaction of the first resin. In addition, the toner satisfies the following relationship: $3 \leqq G = R - R_{ideal} \leqq 20$, wherein, G represents a ratio of a weight of components other than the colorant and the first resin that are included in the toner and are insoluble in the organic solvent, to the total weight of the toner, R represents a weight ratio of insoluble components included in the toner which are insoluble in the organic solvent to the total weight of the toner, and $R_{ideal}$ represents a ratio of an ideal weight ratio of the colorant and the first resin, which is determined from a formula of the toner.

It is preferable that the toner for developing an electrostatic image further include the third resin that does not have any group reactive with a compound having an active hydrogen and a weight ratio of the first resin to the third resin be from 5/95 to 25/75.

It is also preferable that the first resin included in the toner have at least one group that can form a urea linkage in an amount of at least 2 pieces on average per molecule of the first resin.

It is also preferable that each of the first resin and the third resin included in the toner be a polyester resin.

It is also preferable that the colorant included in the toner be a master batch that has been prepared by kneading an unmodified resin and the colorant with one of an organic solvent and water.

It is also preferable that the weight average particle diameter of the toner be 4 to 8 μm and a ratio (WA/NA) of the weight average particle diameter (WA) to the number average particle diameter (NA) is from 1.00 to 1.25

It is also preferable that the toner for developing an electrostatic image have an average circularity of from 0.940 to 0.995.

It is also preferable that the toner include a wax as a release agent.

It is also preferable that the toner include a charge controlling agent.

As another aspect of the present invention, a developer including the toner and a carrier is provided.

As yet another aspect of the present invention, a toner container that contains the toner is provided.

As yet another aspect of the present invention, a process cartridge which contains a photoreceptor, at least one charger configured to charge the photoreceptor, a developing device configured to develop a latent electrostatic image on the photoreceptor with the toner and a cleaning device configured to remove a residual toner on the photoreceptor is provided.

As further another aspect of the present invention, a method of manufacturing a toner is provided that includes the steps of (1) dissolving or dispersing a toner constituent that comprises a first resin that has at least one group reactive with a compound having an active hydrogen in an amount of at least 2 pieces in average per molecule of the first resin and the colorant, in an organic solvent to prepare a toner constituent liquid, and (2) mixing the toner constituent liquid with an aqueous medium that contains fine particles of a resin, and at least one of a crosslinking agent and an elongation agent to perform at least one of a crosslinking reaction and an elongation reaction of the first resin.

As still further another aspect of the present invention, a method of forming a color image that includes the step of developing a latent electrostatic image using the toner mentioned above is provided.

BRIEF DESCRIPTION OF THE DRAWINGS

Various other objects, features and attendant advantages of the present invention will be more fully appreciated as the same becomes better understood from the detailed description when considered in connection with the accompanying drawings, in which like reference characters designate like corresponding parts throughout, and wherein.

DETAILED DESCRIPTION OF THE INVENTION

Figure 1:
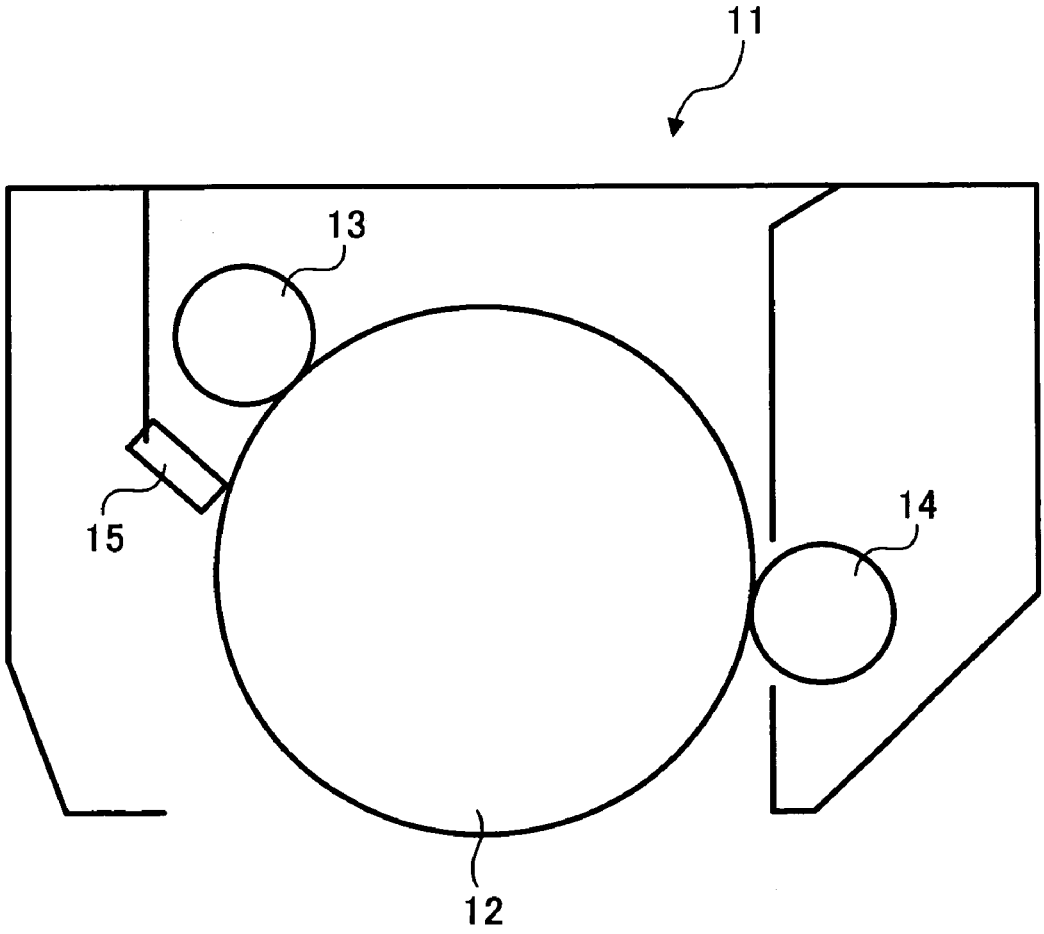
FIG. 1 is a schematic view illustrating the cross section of an embodiment of the process cartridge of the present invention.

The inventors of the present invention have prepared a desired toner by dissolving or dispersing a toner constituent to prepare a toner constituent liquid and mixing the toner constituent liquid with an aqueous medium that contains fine particles of a resin, and a crosslinking agent and/or an elongation agent to perform a crosslinking reaction and an elongation reaction. In this process, the toner constituent is cross-linked and branched and thereby becomes high molecular weighted while the toner constituent is dissolved in a solvent. Therefore low molecular weight components of the toner constituent are intertangled in the crosslinking mesh structure. Therefore, the thus obtained toner has a sufficient elasticity with a small quantity of high molecular weight components, which does not worsen the low temperature fixing property because the toner has low molecular weight components intertangled therein.

Ratio of a Weight of Insoluble Toner Component

A toner component containing a colorant and a binder resin, which has at least one group reactive with a compound having an active hydrogen, is used to obtain a desired toner. The desired toner is prepared by using the toner component and a crosslinking agent and/or an elongation agent to perform a crosslinking reaction and/or elongation reaction. The colorant and the thus obtained crosslinked or elongated resins are expected to be insoluble when the toner is dissolved in a predetermined solvent. But actually there is an unexpectedly insoluble toner component other than the colorant and the crosslinked or elongated resins in the desired toner. The ratio of a weight of such an unexpectedly insoluble toner component is represented by the following relationship: $G=R-R_{ideal}$. In this relationship, R represents a ratio (r1/t) of the total weight of the actual remnant (r1) to the total weight of the desired toner (t) when the desired toner is dissolved. $R_{ideal}$ represents a ratio (r2/t) of the total weight of the theoretical remnant such as a colorant and a crosslinked or elongated resin which is determined from the formula of the toner by calculation (r2) to t.

The ratio R is determined by the following method, which includes the steps of: checkweighing a desired toner; wrapping and sealing the toner with a stainless metal gauze; placing the metal gauze wrapping the toner in a predetermined solvent; stirring the solvent for about 6 hours for eluting the toner; subsequent to drying, weighing the remnant (r1); determining R by calculation based on the weight of the checkweighed toner. Based on the relationship (1), the ratio G is determined by subtracting $R_{ideal}$ which is determined as mentioned above from R.

In the preferred embodiment, the allowable range of G is from 3 to 20 weight % and preferably from 5 to 15 weight %. When G is too small, the amount of intertangeld low molecular weight components decreases. As a result, hot offset tends to occur since the high molecular weight component is present in a small amount and the toner cannot have a sufficient elasticity. When G is too large, the amount of intertangled low molecular weight component increases so that the elasticity of the toner is excessive, resulting in deterioration of low temperature fixability.

Modified Resins

In the preferred embodiment, suitable resins include any known resins that can have a group reactive with a compound having an active hydrogen. Suitable preferred examples of such resins include polyol resins, polyacryl resins, polyester resins and epoxy resins. Among these, polyester resins are more preferable. In addition, suitable groups include any known groups that can react with a compound having an active hydrogen. Suitable preferred examples of the groups include isocyanate group, epoxy groups, carboxylic acids and acid chloride groups. Among these, isocyanate groups are more preferable. Therefore, especially preferred resins for use in the present invention are polyester resins having a group that can form a urea linkage (reactive modified polyester resin=RMPE). Specific examples of RMPEs include a polyester prepolymer (A) having an isocyanate group. Specific examples of the polyester prepolymers (A) include polyesters prepared by reacting with a polyisocyanate (PIC) a polyester which is a polycondensation compound of a polyol and a polycarboxylic acid and which has an active hydrogen group. Specific examples of the active hydrogen group contained in the polyesters mentioned above include hydroxyl groups (alcohol hydroxyl groups and phenol hydroxyl groups), amino groups, carboxylic groups, and mercarpto groups. Among these, alcohol hydroxyl groups are preferable. It is easy to control molecular weights of the high molecular weight components included in modified polyesters (MPE). This is an advantage to secure especially oilless low temperature fixing characteristics of a dry toner. The oilless low temperature fixing characteristics means extensive toner releasing properties and fixability without a mechanism for applying a releasing oil to a heating medium for fixing.

Suitable polyols (PO) include diols (DIO) and polyols (TO) having three or more hydroxyl groups. It is preferable to use a DIO alone or mixtures in which a small amount of a TO is mixed with a DIO.

Specific examples of the diols (DIO) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide); etc.

Among these compounds, alkylene glycols having from 2 to 12 carbon atoms and adducts of a bisphenol with an alkylene oxide are preferable. More preferably, adducts of a bisphenol with an alkylene oxide, or mixtures of an adduct of a bisphenol with an alkylene oxide and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (PC) include dicarboxylic acids (DIC) and polycarboxylic acids (TC) having three or more carboxyl groups. It is preferable to use dicarboxylic acids (DIC) alone or mixtures in which a small amount of a TC is mixed with a DIC.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

As the polycarboxylic acid (TC), anhydrides or lower alkyl esters (e.g., methyl esters, ethyl esters or isopropyl esters) of the polycarboxylic acids mentioned above can be used for the reaction with a polyol.

Suitable mixing ratio (i.e., an equivalence ratio [OH]/[COOH]) of a polyol (PO) to a polycarboxylic acid (PC) is from 2/1 to 1/1, preferably from 1.5/1 to 1/1 and more preferably from 1.3/1 to 1.02/1.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (PIC) to a polyester having a hydroxyl group is from 5/1 to 1/1, preferably from 4/1 to 1.2/1 and more preferably from 2.5/1 to 1.5/1. When the [NCO]/[OH] ratio is too large, the low temperature fixability of the toner deteriorates.

The content of the constitutional component of a polyisocyanate (PIC) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of isocyanate groups included in the prepolymer (A) per molecule is normally not less than 2, preferably from 2 to 3, and more preferably from 2.01 to 2.5.

Crosslinking Agent/Elongation Agent

Specific examples of crosslinking agents and elongation agents used in the present invention include any known crosslinking agents and elongation agents. As crossliking agents and elongation agents especially for modified polyesters, active hydrogen compounds that can react with reacting groups such as isocyanate group and preferably amines (B) can be used. Specific examples of the amines (B) include diamines (B1), polyamines (B2) having three or more amino groups, amino alcohols (B3), amino mercaptans (B4), amino acids (B5), and blocked amines (B6), in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene and tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine (B1) is mixed with a small amount of a polyamine (B2) are preferable.

In the preferred embodiment, not only can the modified polyester (MPE) mentioned above be used alone as a toner binder constituent, but also unmodified polyesters (PE) can be contained as a binder resin in combination with the modified polyesters (MPE). The combined use of MPEs and PEs can improve low temperature fixability and glossness level when used in a full color image developing machine and is therefore preferable to the single use of MPEs alone. Specific preferred examples of the unmodified polyester (PE) include polycondensation products of polyols (PO) and polycarboxylic acids (PC) mentioned above, which are used as polyester constituents of the modified polyester such as UMPE mentioned above. Preferred examples of the PEs include the same as mentioned for the MPEs. It is preferable that PEs and MPEs be at least partially mixed with each other to improve the low temperature fixability and hot offset resistance properties. Therefore, it is preferable, but not mandatory, that the polyester component in MPE have a similar composition to that of the PE. The weight ratio of (MPE)/(PE) is normally from 5/95 to 25/75, preferably from 5/95 to 20/80, more preferably from 7/93 to 20/80 and even more preferably from 10/90 to 15/85. When the content of the MPE is less than 5% by weight, the hot offset resistance of the toner tends to deteriorate and in addition it is hard for the toner to have a good combination of the high temperature preservability and low temperature fixability.

The peak weight average molecular weight of the unmodified polyester (PE) is normally from 1000 to 30000, preferably from 1500 to 10000, and more preferably from 2000 to 8000. When the peak molecular weight is less than 1000, the high temperature preservability tends to deteriorate. When the peak molecular weight is greater than 10,000, the low temperature fixability tends to deteriorate. The hydroxyl group value of the unmodified polyester (PE) is preferably not less than 5 mgKOH/g, more preferably from 10 to 120 mgKOH/g and even more preferably 20 to 80 mgKOH/g. When the hydroxyl group value of the unmodified polyester (PE) is less than 5 mgKOH/g, it is impossible to achieve a good combination of high temperature preservability and low temperature fixability. The acid value of the unmodified polyester (PE) is normally from 1 to 30 mgKOH/g, preferably from 5 to 20 mgKOH/g. By adding the unmodified polyester (PE) having such an acid value, the resultant toner tends to be negatively charged.

In the preferred embodiment, the binder resin preferably has a glass transition temperature (Tg) of from 50 to 70° C., and preferably from 55 to 65° C. When the glass transition temperature is too low, the high temperature preservability of the toner deteriorates. In contrast, when the glass transition temperature is too high, the low temperature fixability deteriorates.

With respect to the storage modulus of the toner binder for use in the toner of the preferred embodiment, the temperature (TG') at which the storage modulus is 10,000 dyne/cm$^2$ when measured at a frequency of 20 Hz is not lower than 100° C., and preferably from 110 to 200° C.

With respect to the viscosity of the toner binder, the temperature (Tη) at which the viscosity is 1,000 poise when measured at a frequency of 20 Hz is not higher than 180° C., and preferably from 90 to 160° C. When the temperature (Tη) is too high, the low temperature fixability of the toner deteriorates. In order to achieve a good combination of low temperature fixability and hot offset resistance, it is preferable that the TG' is higher than the Tη. Specifically, the difference (TG'−Tη) is preferably not less than 0, preferably not less than 10° C. and more preferably not less than 20° C. The difference particularly has no specific upper limit. In order to achieve a good combination of high temperature preservability and low temperature fixability, the difference (TG'−Tη) is preferably from 0 to 100° C., more preferably from 10 to 90° C. and even more preferably from 20 to 80° C.

The toner of the preferred embodiment can be manufactured by the following method, but the manufacturing method thereof is not limited thereto.

Method for Manufacturing the Toner in Aqueous Medium

Suitable aqueous media for use in the toner manufacturing method of the present invention include water, and mixtures of water with a solvent which can be mixed with water. Specific examples of such a solvent include alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

Toner particles can be prepared by reacting a dispersion, in which a polyester prepolymer (A) having an isocyanate group is dispersed in an aqueous medium, with an amine (B).

In order to prepare a dispersion in which a prepolymer (A) is stably dispersed in an aqueous medium, a method, in which toner constituents including a prepolymer (A) are added into an aqueous medium and then dispersed upon application of shear stress, is preferably used.

A prepolymer (A) and other toner constituents such as colorants, master batch pigments, release agents, charge controlling agents, and unmodified polyester resins, may be added into an aqueous medium at the same time when the dispersion is prepared. However, it is preferable that the toner constituents be previously mixed and then the mixed toner constituents be added to the aqueous liquid at the same time to be dispersed. In addition, toner constituents such as colorants, release agents, and charge controlling agents are not necessarily added to the aqueous dispersion before particles are formed, and may be added thereto after particles are prepared in the aqueous medium. For example, a method in which particles, which are previously formed without a colorant, are dyed by a known dying method can also be used.

The dispersion method is not particularly limited, and low speed shearing methods, high speed shearing methods, friction methods, high pressure jet methods, ultrasonic methods, etc. can be used. Among these methods, high speed shearing methods are preferable because particles having a particle diameter of from 2 to 20 μm can be easily prepared. At this point, the particle diameter (2 to 20 μm) means a particle diameter of particles including a liquid.

When a high speed shearing type dispersion machine is used, the rotation speed is not particularly limited, but the rotation speed is typically from 1,000 to 30,000 rpm, and preferably from 5,000 to 20,000 rpm. The dispersion time is not particularly limited, but is typically from 0.1 to 5 minutes. The temperature in the dispersion process is typically from 0 to 150° C. (under pressure), and preferably from 40 to 98° C. It is preferable that the temperature be relatively high. This is because the dispersion has a low viscosity when the temperature is relatively high so that a prepolymer (A) can be easily dispersed.

The weight ratio (T/M) of the toner constituents (T) (including a prepolymer (A)) to the aqueous medium (M) is typically from 100/50 to 100/2,000, and preferably from 100/100 to 100/1,000. When the ratio is too large (i.e., the quantity of the aqueous medium is small), the dispersion of the toner constituents in the aqueous medium is not satisfactory, and thereby the resultant toner particles do not have a desired particle diameter. In contrast, when the ratio is too small, the manufacturing costs increase.

A dispersant can be preferably used when the dispersion is prepared so that the dispersion includes particles having a sharp particle diameter distribution and the dispersion has good dispersion stability.

In the process in which a urea-modified polyester resin is synthesized from a polyester prepolymer (A), an amine (B) can be added to an aqueous medium before toner constituents are dispersed therein, or added to a dispersion in which toner constituents are dispersed in an aqueous medium to react with the prepolymer at the interface therebetween. In the latter case, the urea-modified polyester resin is preferentially formed at the surface portions of the toner particles. Thus, a gradient of the concentration of the urea-modified polyester resin can be generated in the thickness direction of the toner particles.

Specific examples of the dispersants which are used for dispersing or emulsifying an oil phase, in which toner constituents are dissolved or dispersed, in an aqueous liquid, include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi (aminoethyl)glycin, di(octylaminoethyle)glycin, and N-alkyl-N,N-dimethylammonium betaine.

By using a surfactant having a fluoroalkyl group, a dispersion having good dispersibility can be prepared even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl (C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can be used for dispersing an oil phase including toner constituents in water, include primary, secondary and tertiary aliphatic amines having a fluoroalkyl group, aliphatic quaternary ammonium salts such as perfluoroalkyl(C6-C10) sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

An inorganic compound which is hardly soluble in water, such as calcium phosphate, titanium oxide, colloidal silica, and hydroxyapatite can also be used as the dispersant.

Further, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds; acid chlorides (e.g., acrylic acid chloride and methacrylic acid chloride); and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When compounds such as calcium phosphate which are soluble in an acid or alkali are used as a dispersion stabilizer, it is preferable to dissolve calcium phosphate by adding an acid such as hydrochloric acid and to wash the resultant particles with water to remove calcium phosphate therefrom. In addition, such a dispersion stabilizer can be removed using a decomposition method using an enzyme. When a dispersant is used, the dispersant is not necessarily washed away from the surface of the toner particle.

When an aqueous dispersion or emulsion is prepared, a solvent that can dissolve the modified polyester (MPE) such as the urea-modified polyester (UMPE) or prepolymer (A), is preferably used because the resultant particles have a sharp particle diameter distribution. The solvent is preferably volatile and has a boiling point lower than 100° C. This is because the solvent can be easily removed from the dispersion after the particles are formed.

Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The addition quantity of such a solvent is from 0 to 300 parts by weight, preferably from 0 to 100, and more preferably from 25 to 70 parts by weight, per 100 parts by weight of the prepolymer (A) used. When such a solvent is used to prepare a particle dispersion, the solvent is removed therefrom upon application of heat thereto under a normal or reduced pressure condition after the particles are subjected to an elongation reaction and/or a crosslinking reaction.

The crosslinking time and/or the elongation time is determined depending on the reactivity, which is determined by the combination of the prepolymers having an active hydrogen such as polyester prepolymer (A) and amines (B) used as a crosslinking agent and elongation agent. However, the time is in general from 10 minutes to 40 hours, and preferably from 2 to 24 hours. The reaction temperature is generally from 0 to 150° C., and preferably from 40 to 98° C. In addition, a known catalyst such as dibutyltin laurate and dioctyltin laurate can be optionally used for the reaction.

In order to remove the organic solvent from the thus prepared emulsion (dispersion), a drying method, in which the temperature of the emulsion is gradually increased to evaporate the organic solvent from the drops dispersed in the emulsion, can be used. Alternatively, a drying method in which the emulsion is sprayed in a dry atmosphere to evaporate and remove not only the organic solvent in the drops in the emulsion but also the remaining aqueous medium can be used. The dry atmosphere can be prepared by heating gases such as air, nitrogen, carbon dioxide and combustion gases. The temperature of the heated gases is preferably higher than the boiling point of the solvent having the highest boiling point among the solvents used in the emulsion. By using spray dryers, belt dryers, rotary kilns, etc., as a drying apparatus, the drying treatment can be completed in a short period of time.

When the thus prepared toner particles have a wide particle diameter distribution even after the particles are subjected to a washing treatment and a drying treatment, the toner particles are preferably subjected to a classification treatment so that the toner particles have a desired particle diameter distribution.

The classification operation can be performed in a dispersion liquid using a cyclone, a decanter, or a method utilizing centrifuge to remove fine particles therefrom. It is also possible to classify dried toner powder particles. Considering efficiency, it is preferable to subject the liquid including the particles to the classification treatment. The toner particles having an undesired particle diameter can be returned to the kneading process for reuse whether the toner particles are in a wet condition.

It is preferable to remove the dispersant used from the particle dispersion and further preferable to perform the removal treatment at the same time when the classification treatment is performed.

The thus prepared toner powder particles can be mixed with other fine particles such as release agents, charge controlling agents, fluidizing agents and colorants. Such fine particles can be fixed on the toner particles by applying a mechanical impact thereto while the particles and toner particles are integrated. Thus the fine particles can be prevented from being separated from the toner particles.

Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Colorant

Suitable colorants for use in the toner of the present invention include known dyes and pigments.

Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and. GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimonyorange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B. Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination.

The content of the colorant in the toner is preferably from 1 to 15% by weight, and more preferably from 3 to 10% by weight, based on the total weight of the toner.

Master batch pigments, which are prepared by combining a colorant with a resin, can be used as the colorant of the toner composition of the present invention. Specific examples of the resins for use in the master batch pigments or for use in combination with master batch pigments include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins can be used alone or in combination.

The master batch for use in the toner of the present invention is typically prepared by mixing and kneading a resin and a colorant upon application of high shear stress thereto. In this case, an organic solvent can be used to boost the interaction of the colorant with the resin. In addition, flushing methods in which an aqueous paste including a colorant is mixed with a resin solution of an organic solvent to transfer the colorant to the resin solution and then the aqueous liquid and organic solvent are separated to be removed can be preferably used because the resultant wet cake of the colorant can be used as it is. In this case, three-roll mills can be preferably used for kneading the mixture upon application of high shear stress thereto.

Release Agent

A release agent may be included in the toner of the present invention as well as toner binders and colorants. Suitable release agents include known waxes.

Specific examples of the release agent include polyolefin waxes such as polyethylene waxes and polypropylene waxes; long chain hydrocarbons such as paraffin waxes and SAZOL waxes; waxes including a carbonyl group, etc. Among these waxes, the waxes including a carbonyl group are preferably used.

Specific examples of the waxes including a carbonyl group include polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkylamide such as trimellitic acid tristearylamide; dialkyl ketone such as distearyl ketone, etc. Among these materials, polyalkane acid esters are preferable.

The waxes for use in the toner of the present invention preferably have a melting point of from 40 to 160° C., more preferably from 50 to 120° C., and even more preferably from 60 to 90° C. When the melting point of the wax included in the toner is too low, the high temperature preservability of the toner deteriorates. In contrast, when the melting point is too high, a cold offset problem, in that an offset phenomenon occurs at a low fixing temperature, tends to occur.

The wax used in the toner of the present invention preferably has a melt viscosity of from 5 to 1000 cps and more preferably from 10 to 100 cps at a temperature 20° C. higher than the melting point of the wax. When the melt viscosity is too high, the effect of improving the hot offset resistance and low temperature fixability is lessened. The content of the wax in the toner is from 0 to 40% by weight and preferably from 3 to 30% by weight based on the total weight of the toner.

Charge Controlling Agent

A charge controlling agent may be included in the toner of the present invention.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large of a charge quantity, and thereby the electrostatic force of a developing roller attracting the toner increases, resulting in deterioration of the fluidity of the toner and a decrease of the image density of toner images.

The charge controlling agent can be dissolved or dispersed in an organic solvent after kneaded together with a master batch pigment and resin. In addition, the charge controlling agent can be directly dissolved or dispersed in an organic solvent when the toner constituents are dissolved or dispersed in the organic solvent. Alternatively, the charge controlling agent may be fixed on the surface of the toner particles after the toner particles are prepared.

Resin Particles

Suitable resins for use as the resin particles of the present invention include any known resins that can form an aqueous dispersion.

Specific examples of these resins include thermoplastic resins and thermosetting resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resins, vinyl resins, polyurethane resins, epoxy resins, polyester resins, and mixtures thereof are preferably used because an aqueous dispersion including fine spherical particles can be easily prepared.

Specific examples of the vinyl resins include polymers, which are prepared by polymerizing a vinyl monomer or copolymerizing vinyl monomers, such as styrene-(meth) acrylate resins, styrene-butadiene copolymers, (meth)acrylic acid-acrylate copolymers, styrene-acrylonitrile copolymers, styrene-maleic anhydride copolymers and styrene-(meth) acrylic acid copolymers.

External Additive

The thus prepared toner particles may be mixed with an external additive to assist in improving the fluidity, developing property, and charging ability of the toner particles. Suitable external additives include particulate inorganic materials. It is preferable for the particulate inorganic materials to have a primary particle diameter of from 5 nm to 2 μm, and more preferably from 5 nm to 500 nm. In addition, it is preferable that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on total weight of the toner.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

In addition, particles of polymers such as polymers and copolymers of styrene, methacrylates, acrylates or the like; polymers prepared by polycondensation polymerization, such as silicone resins, benzoguanamine resins and nylon resins; and thermosetting resins, which can be prepared by a soap-free emulsion polymerization method, a suspension polymerization method or a dispersion polymerization method, can also be used as the external additive.

These materials for use as the external additive can be subjected to a surface treatment to be hydrophobized, thereby preventing the fluidity and charge properties of the toner even under high humidity conditions. Specific examples of the hydrophobizing agents include silane coupling agents, silylation agents, silane coupling agents including a fluoroalkyl group, organic titanate coupling agents, aluminum coupling agents, silicone oils, modified silicone oils, etc.

The toner of the present invention may include a cleanability improving agent to improve the cleaning ability thereof such that the toner remaining on an image bearing member such as photoreceptors and intermediate transfer belts can be easily removed therefrom. Specific examples of the cleanability improving agents include fatty acids and metal salts thereof such as zinc stearate, calcium stearate and stearic acid; polymer particles which are prepared by a soap-free emulsion polymerization method or the like, such as polymethyl methacrylate particles and polystyrene particles; etc. The polymer particles preferably have a narrow particle diameter distribution and the weight average particle diameter thereof is preferably from 0.01 to 1 μm.

Spherical Degree and Spherical Degree Distribution

It is important for the toner of the preferred embodiment of the present invention to have a specific spherical degree and a specific spherical degree distribution. When the toner has an average spherical degree less than 0.90, i.e., the toner has a form greatly different from a spherical form, toner powder fluidity deteriorates and high quality images cannot be produced (for example, transferability deteriorates and the resultant images have background fogging).

In the present invention, the spherical degree of a toner is measured as follows:

(1) a suspension including particles (i.e., a toner) to be measured is passed through a detection area formed on a plate in the measuring instrument (a flow-type particle image analyzer); and (2) the particles are optically observed by a CCD camera to analyze the shapes thereof.

The spherical degree of a particle is determined by the following equation:

$$\text{Spherical degree} = Cs/Cp$$

wherein Cp represents the length of the circumference of the projected image of a particle and Cs represents the length of the circumference of a circle having the same area as that of the projected image of the particle.

When the average spherical degree is from 0.940 to 0.995, the resultant toner can stably produce high quality images having a proper image density and a high resolution. It is more preferable for the toner of the present invention to have an average spherical degree of from 0.960 to 0.995. In addition, in the toner of the present invention the content of the toner particles having a spherical degree less than 0.940 is not greater than 10%.

When the average spherical degree is greater than 0.995, the toner particles remaining on an image bearing member such as photoreceptors cannot be fully removed, resulting in formation of background fouling in the resultant toner images. When images having small image area are developed or transferred, the amount of residual toner (i.e., toner remaining on an image bearing member) is little, and therefore the above-mentioned cleaning problem hardly occurs. However, when images having a large image area such as photograph images are formed or toner images formed on an image bearing member are not transferred on a receiving material due to an accident such as mis-feeding of a receiving material, the amount of the residual toner increases. When the residual toner accumulates on the image bearing member, a background fouling problem occurs. In addition, when a contact charger such as charging roller is used, the residual toner contaminates the contact charger, and thereby the charging ability of the charger deteriorates.

Ratio (Dw/Dn)

The ratio (Dw/Dn) (weight average particle diameter/number average particle diameter) will be explained in detail.

The weight average particle diameter (Dw) of the dry toner of the present invention is from 4 to 8 μm, and the ratio Dw/Dn of the weight average particle diameter (Dw) to the number average particle diameter (Dn) is not greater than 1.25 and preferably from 1.10 to 1.25. When such a dry toner is used in a full color copier, images obtained have an excellent gloss. Further, when such a dry toner is used for a two component developer while a cyclic operation of consumption and replenishment of the toner is repeatedly performed in an extended period of time, the particle diameter of the toner particles in the two component developer hardly changes, and thereby stable development can be performed (i.e., good images can be stably produced) for a long period of time even if the toner is repeatedly agitated in the developing device in an extended period of time.

In addition, when the toner is used as a one component developer, the toner does not cause problems such that a toner film is formed on the developing roller used and the toner adheres to a member such as blades configured to regulate the toner to form a thin toner layer. Therefore, even when the toner is used in a developing device and repeatedly agitated in a long period of time, stably development can be performed and good images can be stably produced.

In general, the smaller particle diameter a toner has, the better the image qualities of the resultant toner images. However, the smaller particle diameter a toner has, the worse transferability and cleaning property the toner has. When the toner has a weight average particle diameter less than 4 μm, the toner tends to adhere to the surface of the carrier included in a two component developer if the developer is repeatedly agitated in a long period of time, resulting in deterioration of the charging ability of the carrier. When such a small toner is used as a one component developer, the toner tends to cause problems such that a toner film is formed on the developing roller used and the toner adheres to a member such as blades configured to regulate the toner to form a thin toner layer. The same is true for the case in which the toner includes a large amount of fine toner particles.

In contrast, when the weight average particle diameter of the toner is greater than 8 μm, it is hard to produce high resolution and high quality images, and in addition, the particle diameter of the toner greatly changes if a cyclic operation of consumption and replenishment is repeatedly performed. The same is true for the case in which the ratio Dw/Dn is greater than 1.25.

Carrier for Use in Two-component Developer

The toner of the present invention can be used for a two-component developer in which the toner is mixed with a magnetic carrier. The weight ratio (T/C) of the toner (T) to the carrier (C) is preferably from 1/100 to 10/100.

Suitable carriers for use in the two component developer include known carrier materials such as iron powders, ferrite powders, magnetite powders, magnetic resin carriers, which have a particle diameter of from about 20 to about 200 μm. The surface of the carriers may be coated by a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic developer or a one-component non-magnetic developer.

FIG. 1 is a schematic view illustrating the cross section of an embodiment of the process cartridge of the present invention. Numeral 11 denotes a process cartridge. The process cartridge 11 includes a photoreceptor 12 serving as an image bearing member bearing a latent electrostatic image thereon, a charger 13 that charges the photoreceptor 12, a developing roller 14 serving as a member of a developing device that develops the latent electrostatic image on the photoreceptor 12 with the developer of the present invention to form a toner image on the photoreceptor 12, and a cleaning blade 15, which serves as a cleaner and which removes toner particles remaining on the surface of the photoreceptor 12 after the toner image on the photoreceptor 12 is transferred onto a receiving material (not shown).

The process cartridge is not limited to the process cartridge 11 illustrated in the figure. Any process cartridges including at least an image bearing member and a developing device including the toner of the present invention can be used as the process cartridge of the present invention.

The process cartridge of the present invention is detachably set in an image forming apparatus. In the image forming apparatus in which the process cartridge is set, the photoreceptor 12 is rotated at a predetermined rotation speed. The photoreceptor 12 is charged with the charger 13 and thereby the photoreceptor 12 is uniformly charged positively or negatively. Then an image irradiating device (not shown) irradiates the charged surface of the photoreceptor 12 with light using a method such as slit irradiation methods and laser beam irradiation methods, resulting in formation of electrostatic latent image on the photoreceptor 12.

The thus prepared electrostatic latent image is developed by the developing roller 14 bearing the developer of the present invention thereon, resulting in formation of a toner image on the photoreceptor 12. The toner image is then transferred onto a receiving material (not shown) which is timely fed by a feeding device (not shown) to a transfer position between the photoreceptor 12 and a transfer device (not shown).

The toner image formed on the receiving material is then separated from the photoreceptor 12 and fixed by a heat/pressure fixing device (not shown) including a fixing roller. The fixed image is discharged from the image forming apparatus. Thus, a hard copy is produced.

The surface of the photoreceptor 12 is cleaned by the cleaning blade 15 to remove toner remaining on the photoreceptor 12, followed by discharging, to be ready for the next image forming operation.

As the color image forming method of the present invention, conventional color image forming methods can be used but the toner used therefor is the toner of the present invention.

As the color image forming apparatus using the color image forming method of the present invention, conventional image forming apparatuses can be used but the toner used therefor is the toner of the present invention.

The color image forming method of the present invention and the image forming device using the method will be explained with reference to FIG. 2.

Figure 2:
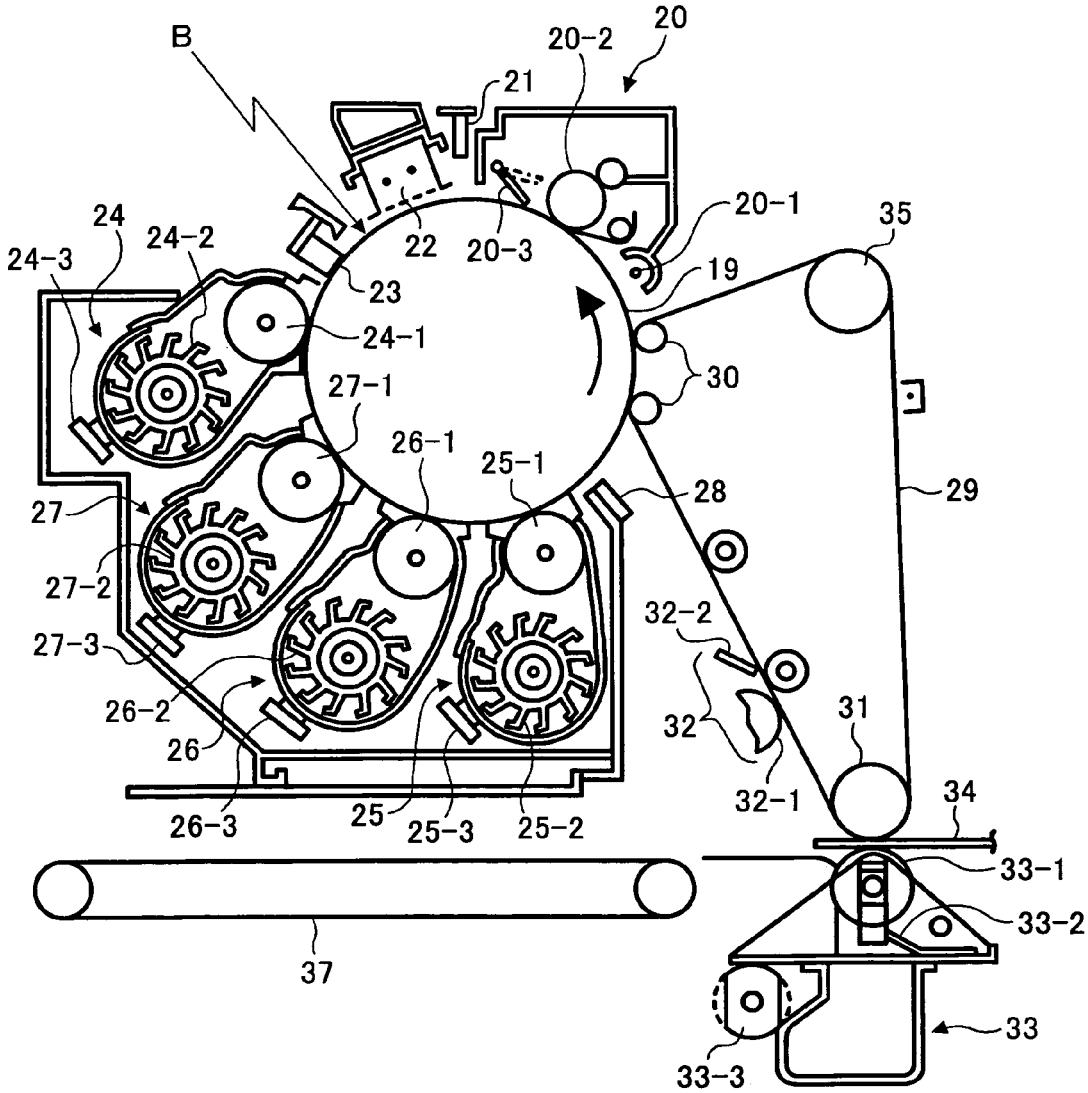
FIG. 2 is a schematic view illustrating an embodiment of the image forming apparatus using the image forming method of the present invention.

FIG. 2 is a schematic view illustrating an embodiment of the image forming apparatus using the image forming method of the present invention.

Numeral 19 denotes a photoreceptor that rotates in the counterclockwise direction indicated by an arrow. Around the photoreceptor 19 are arranged a cleaning unit 20 which includes a pre-cleaning discharger 20-1, a cleaning roller 20-2, and a cleaning blade 20-3 and which cleans the surface of the photoreceptor 19; a discharge lamp 21, which discharges charges remaining on the photoreceptor 19; a charger 22 that charges the photoreceptor 19; a potential sensor 23; a black (BK) image developer 24; a cyan (C) image developer 25; a magenta (M) image developer 26; a yellow (Y) image developer 27; a developing density pattern detector 28; and an intermediate transfer medium 29.

Each image developer 24, 25, 26 and 27 is constructed of a developing sleeve (24-1, 25-1, 26-1 and 27-1, respectively) which rotates to carry a developer such that each developer faces the photoreceptor 19; a paddle (24-2, 25-2, 26-2 and 27-2, respectively) which rotates to scoop up and agitate each developer; and a toner concentration detecting sensor (24-3, 25-3, 26-3 and 27-3, respectively) which detects the toner concentration of each developer. The image developers 24, 25, 26 and 27 include respective BK, C, M and Y developers including BK, C, M and Y toners, respectively. The toners are the toner of the preferred embodiment of the present invention.

The image forming process will be explained in detail when BK, C, M and Y images are formed in this order. The developing order is not limited thereto.

When a coping operation is started, a laser beam B irradiates the photoreceptor 19 according to the BK image data, which are prepared by reading an original image using a color scanner (not shown) to form a BK latent image thereon. The developing sleeve 24-1 starts to rotate before the tip of the BK latent image reaches the developing position in the BK image developer 24 to develop the BK latent image with the BK toner. This developing operation is continued until the rear end of the BK latent image passes the developing position. The BK image developer 24 achieves a dormant state before the C developing operation is started.

The BK toner image formed on the photoreceptor 19 is transferred onto the intermediate transfer belt 29 which is fed at the same speed as that of the photoreceptor 19. Hereinafter this toner transfer is referred to as the first transfer. The first transfer is performed while the photoreceptor 19 is contacted with the intermediate transfer belt 29 and a predetermined bias voltage is applied to a first transfer bias roller 30. Similarly to the BK first transfer, C, M, and Y first transfers are performed such that the BK, C, M, and Y toner images (i.e., a full color image) are formed on the proper positions of the intermediate transfer belt 29. All of the thus prepared four color images are then transferred onto a receiving paper 34 at once. Thus, a full color image is formed on the receiving paper 34.

The BK image forming process is followed by a C image forming process. A laser beam B irradiates the photoreceptor 19 according to the C image data, which are prepared by reading the original image using the color scanner (not shown) to form a C latent image thereon. The developing sleeve 25-1 starts to rotate to elect the C developer after the rear end of the BK latent image passes the developing position in the C image developer 25 and before the tip of the C latent image reaches the developing position. Thus, the C latent image is developed with the C toner which has a charge quantity larger than the BK toner. This C developing operation is continued until the rear end of the C latent image passes the C developing position. Similarly to the BK developing operation, the C image developer 25 achieves a dormant state (i.e., the filamanets of the C developer are laid) before the M developing operation is started.

The M and Y image developing operations are performed in the same way as performed in the BK and C image developing operations. In this case, the M toner has a charge quantity larger than the C toner, and the Y toner has a charge quantity larger than the M toner.

The intermediate transfer belt 29 bears the BK, C, M and Y images thereon, and is tightened by a drive roller 31, the first transfer bias roller 30, and a driven roller 35. The intermediate transfer belt 29 is driven by a stepping motor (not shown).

A belt cleaning unit 32 includes a brush roller 32-1 and a rubber blade 32-2, and contacts and is detached from the intermediate transfer belt 29 by a touch/detach mechanism (not shown). After the BK image is transferred onto the intermediate transfer belt 29, the belt cleaning unit 32 is detached from the intermediate transfer belt 29 during the C, M and Y first transfers. After the second transfer, the belt cleaning unit 32 is touched to the intermediate transfer belt 29 to clean the surface of the intermediate transfer belt 29.

A paper transfer unit 33 includes a paper transfer bias roller 33-1, a roller cleaning blade 33-2, and a belt touch/detach mechanism 33-3 configured to touch (or detach) the paper transfer unit 33 to (from) the intermediate transfer belt 29. The bias roller 33-1 is ordinarily separated from the intermediate transfer belt 29. When the four color images (i.e., the full color image) formed on the intermediate transfer belt 29 are transferred onto the receiving material 34 at once, the receiving paper 34 is timely pressed by the belt touch/detach mechanism 33-3 to transfer the color images onto the proper position of the receiving paper 34 while a bias voltage is applied to the receiving paper 34 by the roller 33-1.

Then the receiving paper 34 is timely fed by a paper feeding unit 37 to a fixer (not shown). In the fixer, the color images on the receiving paper 34 are fixed at a nip between a fixing roller, which is controlled so as to have a predetermined temperature and a pressure roller. Thus a full color copy is prepared.

After the first transfer, the photoreceptor 19 is cleaned by the cleaning unit 20, and then discharged uniformly by the discharge lamp 21.

After transferring the color toner images onto the receiving paper 34, the intermediate transfer belt 29 is cleaned by the cleaning unit 32, which is again contacted to the intermediate transfer belt 29 by the touch/detach mechanism.

When the copying operation is repeated, the BK image forming process of the second copy is timely performed after the Y image forming process of the first copying operation. On the cleaned area of the intermediate transfer belt 29, the BK image of the second copy is transferred. The C, M and Y images of the second copy are also transferred onto the intermediate transfer belt 29 in the same way as performed for the first copy.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Emulsion of Resin Particles

Manufacturing Example 1

In a reaction container equipped with a stirrer and a thermometer, 683 parts of water, 11 parts of a sodium salt of sulfate of an adduct of methacrylic acid with ethyleneoxide (EREMINOR RS-30 from Sanyo Chemical Industries Ltd.), 138 parts of styrene, 138 parts of methacrylic acid, and 1 part of ammonium persulfate were added and the mixture was agitated for 15 minutes at a revolution of 400 rpm. As a result, a white emulsion was obtained. Then the emulsion was heated to 75° C. to perform a reaction for 5 hours. Then 30 parts of a 1% aqueous solution of ammonium persulfate were added to the emulsion and the mixture was further aged for 5 hours at 75° C. Thus, an aqueous dispersion (particle dispersion 1) of a vinyl resin (i.e., a copolymer of styrene-methacrylic acid-a sodium salt of a sulfate of an adduct of methacrylic acid with ethyleneoxide) was prepared.

Preparation of Aqueous Phase

Manufacturing Example 2

Eighty (80) parts of the particle dispersion 1 were mixed with 990 parts of water, 40 parts of a 48.5% aqueous solution of sodium dodecyldiphenyletherdisulfonate (EREMINOR MON-7 from Sanyo Chemical Industries, Ltd.), and 90 parts of ethyl acetate. Thus, an aqueous phase 1 was prepared.

Preparation of Prepolymer

Manufacturing Example 3

In a reaction container equipped with a condenser, a stirrer and a pipe from which a nitrogen gas was supplied to the container, 410 parts of the intermediate polyester 1, 89 parts of isophorondiisocyanate and 500 parts of ethyl acetate were added. The mixture was reacted for 5 hours at 100° C. Thus, a prepolymer 1 was prepared.

Synthesis of Ketimine

Manufacturing Example 4

In a reaction container equipped with a stirrer and a thermometer, 170 parts of isophoronediamine and 75 parts of methyl ethyl ketone were mixed. The mixture was reacted for 5 hours at 50° C. Thus, a ketimine compound 1 was prepared.

Preparation of Master Batch

Manufacturing Example 5

One thousand two hundred (1200) parts of water, 540 parts of carbon black (Printex 35 from Degussa AG) which has a dibutyl phthalate (DBP) oil absorption of 42 ml/100 mg and has a PH of 9.5, and 1200 parts of a polyester resin were mixed in a Henshel mixer (manufactured by Mitsui Mining Company, Limited). This mixture was kneaded for 30 minutes at 150° C. using a two-roll mill followed by rolling and cooling. Then the kneaded mixture was pulverized. Thus, a master batch 1 was prepared.

Example 1

Preparation of Oil Phase

In a reaction container equipped with a stirrer and a thermometer, 378 parts of polyester 1 which has a functional group number of 2.25, 110 parts of a synthesized ester wax (pentaerythritol tetrabehenate), 22 parts of a metal complex of salicylic acid serving as a charge controlling agent (E-84 from Orient Chemical Industries Co., Ltd.) and 947 parts of ethyl acetate were mixed. The mixture was heated to 80° C. and kept at 80° C. for 5 hours while being agitated and then cooled down to 30° C. in 1 hour. Then 500 parts of the master batch 1 and 500 parts of ethyl acetate were added to the reaction container and mixed for 1 hour. Thus, a toner constituent solution 1 was prepared.

Then 1324 parts of the toner constituent solution 1 were transferred into a container, and then dispersed using a bead mill (ULTRAVISCOMILL from AIMEX) under the following conditions:

Liquid feeding speed: 1 kg/hr,
Disc rotation speed: 6 m/sec,
Diameter of beads: 0.5 mm,
Filling factor: 80% by volume, and
Repeat number of dispersion treatment: 3 times.

Thus, the pigment and wax were dispersed. Then 1324 parts of a 65% ethyl acetate solution of the polyester 1 were added thereto, and the mixture was dispersed under the conditions mentioned above except that the repeat number of the dispersion treatment was changed to 1 time. Thus, a dispersion 1 was prepared.

Emulsification and Solvent Removal

The following components were contained in a container to be mixed for 1 minute using a TK HOMOMIXER (manufactured by Tokushu Kika Kogyo Co., Ltd.) at a revolution of 5,000 rpm.

Pigment/wax dispersion 1
664
Prepolymer 1
100
Ketimine compound 1
4.2

Then, 1200 parts of the aqueous phase 1 were added thereto and the mixture was dispersed for 20 minutes using a TK HOMOMIXER at a revolution of 13,000 rpm. Thus, an emulsion slurry 1 was prepared.

In a container equipped with a stirrer and a thermometer, the emulsion slurry 1 was added and then was heated at 30° C. for 8 hours to remove the solvents therefrom.

Washing and Drying

One hundred (100) parts of the emulsion slurry 1 were filtered by filtering under a reduced pressure. Then the following operations were performed.

(1) 100 parts of deionized water were added to the thus prepared cake and the mixture was mixed for 10 minutes by a TK HOMOMIXER at a revolution of 12,000 rpm and then filtered;

(2) 100 parts of a 10% aqueous solution of sodium hydroxide were added to the cake prepared in (1) and the mixture was mixed for 30 minutes by a TK HOMOMIXER at a revolution of 12,000 rpm while applying supersonic vibration thereto, and then filtered under a reduced pressure, wherein this washing using an alkali was repeated twice;

(3) 100 parts of a 10% hydrochloric acid were added to the cake prepared in (2) and the mixture was mixed for 10 minutes by a TK HOMOMIXER at a revolution of 12,000 rpm and then filtered; and (4) 300 parts of deionized water were added to the cake prepared in (3) and the mixture was mixed for 10 minutes by a TK HOMOMIXER at a revolution of 12,000 rpm and then filtered, wherein this washing was repeated twice to prepare a filtered cake 1.

The filtered cake 1 was dried for 48 hours at 45° C. using a circulating drier. The dried cake was sieved using a screen having openings of 75 μm. One hundred (100) parts of the toner particles, 0.5 parts of hydrophobic silica and 0.5 parts of hydrophobic titan oxide were mixed in a Henshel mixer. Thus a toner 1 was prepared.

Example 2

A toner 2 was prepared in the same manner as illustrated in Example 1 except that 100 parts of prepolymer 1 was reduced to 80 parts.

Example 3

A toner 3 was prepared in the same manner as illustrated in Example 1 except that the polyester 1 having a functional group number of 2.25 was changed to a polyester 2 having a functional group number of 3.31.

Example 4

A toner 4 was prepared in the same manner as illustrated in Example 1 except that 100 parts of the polyester 1 which has a functional group number of 2.25 is replaced with 80 parts of the polyester 2 which has a functional group number of 3.31.

Example 5

A toner 5 was prepared in the same manner as illustrated in Example 1 except that 500 parts of the master batch 1 and 500 parts of acetic ether were replaced with 200 parts of carbon black (Printex 35 manufactured by Degussa AG) and 800 parts of acetic ether.

Example 6

A toner 6 was prepared in the same manner as illustrated in Example 1 except that, in the emulsification and solvent removal process, the components were mixed with a TK HOMOMIXER (manufactured by Tokushu Kika Kogyo Co., Ltd.) not at a revolution of 13,000 rpm for 20 minutes but at a revolution of 5,000 rpm for 10 minutes.

Example 7

A toner 7 was prepared in the same manner as illustrated in Example 1 except that, in the emulsification and solvent removal process, the solvent removal was not performed for 8 hours at 30° C. but for 2 hours at 45° C.

Comparative Example 1

A comparative toner 1 was prepared in the same manner as illustrated in Example 1 except that 100 parts of the prepolymer 1 was changed to 15 parts.

Comparative Example 2

A comparative toner 1 was prepared in the same manner as illustrated in Example 1 except that 100 parts of the prepolymer 1 was changed to 170 parts.

Comparative Example 3

A comparative toner 3 was prepared in the same manner as illustrated in Example 1 except that the polyester 1 which had a functional group number of 2.25 was replaced with a polyester 3 which had a functional group number of 1.67.

One hundred (100) parts of the thus prepared toners were mixed with 0.7 parts of a hydrophobic silica and 0.3 parts of a hydrophobic titanium oxide using a Henshel mixer.

The thus prepared toner with external additives was mixed with a copper-ferrite carrier which had been coated with a silicone resin and which had an average particle diameter of 40 μm in a weight ratio of 5:95 to prepare a developer.

The evaluation items are as follows.

Evaluation Items (1) Particle Diameter (Dv, Dn)

The particle diameters (i.e., weight average particle diameter and number average particle diameter) of a toner were measured with a particle diameter measuring instrument, COULTER COUNTER TAII, manufactured by Coulter Electronics, Inc., which was equipped with an aperture having a diameter of 100 μm.

(2) Spherical Degree (S.D.)

The spherical degree can be measured by a flow type particle image analyzer FPIA-2100 manufactured by SYSMEX CORPORATION. The average circularity of each toner was determined.

The specific procedure is as follows:

1) a surfactant serving as a dispersant, preferably 0.1 to 5 ml of an alkylbenzenesulfonic acid salt, is added to 100 to 150 ml of water from which solid impurities have been removed;

2) 0.1 to 0.5 g of a sample to be measured is added into the mixture prepared in (1);

3) the mixture prepared in (2) is subjected to an ultrasonic dispersion treatment for about 1 to 3 minutes such that the concentration of the particles is 3,000 to 10,000 particles per microlitter; and 4) the shape and average particle diameter distribution of the sample are determined using the instrument mentioned above.

(3) Fixability

Each developer was set in a copier, IMAGIO NEO 450, which can produce 45 copies of A4 size per minute, and black solid images were continuously produced on a plain copying paper (TYPE 6000 <70W> paper from Ricoh Co., Ltd.) while the fixing conditions were controlled such that the fixed amount of the solid toner image is 1.0±0.1 mg/cm$^2$.

In addition, the temperature of the fixing belt was changed under the following conditions to determine the cold offset temperature (the lower limit fixing temperature) and the hot off set temperature (the hot offset resistance temperature).

Linear velocity of fixing: 180+ or −2 mm/sec

Nipping width of fixing: 10+ or −1 mm.

The evaluation criteria for each characteristic are as follows.

(a) Low Temperature Fixing Property (1 to 5 Rating System)

E: lower than 130° C.

G: from 130 to 140° C.

F: from 140 to 150° C.

B: from 150 to 160° C.

P: higher than 160° C.

(b) Hot Offset Resistance Property (1 to 5 Rating System)

E: higher than 200° C.

G: from 190 to 200° C.

F: from 180 to 190° C.

B: from 170 to 180° C.

P: lower than 170° C.

(4) Image Granulation Property

A single-color output of a photographic image was observed with a naked eye to determine the level of image granulation. The evaluation criteria are as follows:

E: excellent

G: good

F: fair enough for practical use

B: bad for practical use (5) Agglomeration Level

The measuring device used was a powder tester manufactured by Hosokawa Micron Corporation. The accessories were set on the vibration board of the measuring device in the following order:

(i) vibroshoot (ii) packing (iii) space ring (iv) 3 screens having different openings: the size of the openings thereof becomes smaller in the order of the upper screen, middle screen and lower screen (v) fastening bar Then the vibration board was fastened with a knob nut. The measuring conditions were as follows:

Opening of the upper screen: 75 μm

Opening of the middle screen: 45 μm

Opening of the lower screen: 22 μm

Scale range: 1 mm

The amount of developer sample: 10 g

Vibration time: 30 seconds.

After measurement, the agglomeration level was determined by the following calculations.

The agglomeration level=a+b+c, wherein a=(A/D)×100, b=(B/D)×100×3/5 and c=(C/D)×1/5, wherein A represents the amount of the developer sample remaining on the upper screen, B represents the amount of the developer sample remaining on the middle screen, C represents the amount of the developer sample remaining on the lower screen and D represents the amount of the developer sample.

The evaluation results are shown below.

In the case of Comparative Example 3, the ratio G is less than 0 (i.e., −2). This is thought to be because the number of functional groups contained in the polyester 1 used in Comparative Example 3 is too small (i.e., 1.67) to form a mesh structure having a molecular weight large enough to be insoluble to a predetermined organic solvent.

As can be understood from Table 1, the toner of the present invention has a good combination of low temperature fixability and hot offset resistance.

Having now fully described embodiments of the present invention, it will be apparent to one of ordinary skill in the art that many changes and modifications can be made thereto without departing from the spirit and scope of embodiments of the invention as set forth herein.

The invention claimed is:

1. A toner for developing an electrostatic image, comprising:

a first resin; and a colorant, which is prepared by (1) dissolving or dispersing the colorant and the first resin in an organic solvent to prepare a toner constituent liquid; and (2) mixing the toner constituent liquid with an aqueous medium that includes fine particles of a second resin, and at least an agent selected from the group consisting of a dispersant, an emulsifying agent, and a surfactant, wherein the toner satisfies the following relationship:

$$3 \leqq G = R - R_{ideal} \leqq 20,$$

wherein G represents a ratio of a weight of components other than the colorant and the first resin that are included in the toner and are insoluble in the organic solvent, to a total weight of the toner, R represents a weight ratio of insoluble components included in the toner, which are insoluble in the organic solvent, to the total weight of the toner, and $R_{ideal}$ represents an ideal weight ratio of the colorant and the first resin and is determined from a formula of the toner.

2. The toner of claim 1, wherein the first resin has at least one group reactive with a compound having an active

TABLE 1

| | ratio G (=R − $R_{ideal}$) | Fixing property | | Particle diameter | | | Spherical degree (S.D.) | Granulation level | Agglomeration level |
|---|---|---|---|---|---|---|---|---|---|
| | | Cold offset temperature ° C. | Hot offset resistance temperature ° C. | Weight average particle diameter (WA) (μm) | Number average particle diameter (NA) (μm) | WA/NA | | | |
| Example 1 | 12 | G | G | 5.1 | 4.2 | 1.21 | 0.986 | G | 7.5 |
| Example 2 | 8 | G | G | 5.2 | 4.5 | 1.16 | 0.979 | E | 8.1 |
| Example 3 | 18 | F | G | 6.0 | 5.0 | 1.20 | 0.970 | G | 8.2 |
| Example 4 | 16 | G | G | 4.8 | 4.2 | 1.14 | 0.981 | E | 7.2 |
| Example 5 | 9 | G | G | 6.9 | 5.9 | 1.17 | 0.972 | G | 8.2 |
| Example 6 | 8 | G | G | 8.2 | 5.9 | 1.39 | 0.962 | B | 8.3 |
| Example 7 | 9 | G | G | 6.8 | 5.6 | 1.21 | 0.911 | G | 18.1 |
| Comparative Example 1 | 2 | G | B | 4.9 | 4.3 | 1.14 | 0.985 | E | 7.3 |
| Comparative Example 2 | 29 | P | G | 5.5 | 4.8 | 1.15 | 0.974 | E | 8.2 |
| Comparative Example 3 | −2 | G | P | 5.3 | 4.5 | 1.18 | 0.990 | G | 6.9 |

hydrogen in an amount of at least an average of two pieces per molecule of the first resin.

3. The toner of claim 1, wherein the toner is mixed with at least one of a crosslinking agent and an elongation agent to perform at least one of a crosslinking reaction and an elongation reaction of the first resin.

* * * * *